United States Patent [19]

Ball

[11] Patent Number: 4,735,713

[45] Date of Patent: Apr. 5, 1988

[54] LAMINATION DISPENSER

[75] Inventor: Arthur E. Ball, Salt Lake City, Utah

[73] Assignee: Acme Electric Corporation, Olean, N.Y.

[21] Appl. No.: 911,169

[22] Filed: Sep. 24, 1986

[51] Int. Cl.[4] ..... G07F 11/00

[52] U.S. Cl. ..... 221/13; 221/207; 221/241; 414/115; 414/131; 29/809; 29/714; 271/142

[58] Field of Search ..... 29/732, 738, 809, 709, 29/714; 414/115, 131; 221/13, 207, 241; 271/142

[56] References Cited

U.S. PATENT DOCUMENTS

| | | | |
|---|---|---|---|
| 1,677,938 | 7/1928 | Van Sickle | 221/241 |
| 1,966,878 | 7/1934 | Bluzat | 271/142 |
| 2,457,187 | 12/1948 | Steiner | 221/207 |
| 3,136,043 | 6/1964 | Ruellan . | |
| 3,280,453 | 10/1966 | Clark | 29/738 |
| 3,423,814 | 1/1969 | Davis | 29/714 |
| 3,955,264 | 5/1976 | Klappert . | |
| 4,073,373 | 2/1978 | Crowley . | |
| 4,238,879 | 12/1980 | Zurlinden, III . | |
| 4,439,100 | 3/1984 | Fichtner et al. | 414/131 |
| 4,513,957 | 4/1985 | Schafer, Jr. | 221/13 |
| 4,544,315 | 10/1985 | Muskulus | 414/131 |
| 4,586,236 | 5/1986 | Jones . | |

FOREIGN PATENT DOCUMENTS

| | | | |
|---|---|---|---|
| 211232 | 2/1960 | Austria | 414/131 |

*Primary Examiner*—P. W. Echols

*Attorney, Agent, or Firm*—Pearne, Gordon, McCoy & Granger

[57] ABSTRACT

A dispenser is provided to dispense laminations to a forward position whereat they may readily be manually grasped for withdrawal from a dispenser and insertion into a preformed coil. One or more laminations may be dispensed in a selected group of laminations so that this entire selected group may be withdrawn at one time and need not be separately manipulated to align those laminations before they can be inserted into the coil. When the laminations are withdrawn from the forward dispensing position, a proximity sensor senses the absence of such laminations and controls an actuator to transversely move laminations from the bottom of the stack of laminations in the dispenser to the forward position, ready to be withdrawn by the operator, and then the actuator withdraws to the rearward position. Abutment means are axially adjustable to select one, two or more laminations in the selected group of laminations being dispensed to the forward position. The foregoing abstract is merely a resume of one general application, is not a complete discussion of all principles of operation or applications, and is not to be construed as a limitation on the scope of the claimed subject matter.

20 Claims, 2 Drawing Sheets

LAMINATION DISPENSER

BACKGROUND OF THE INVENTION

Laminations are used in alternating current devices such as motors and transformers in order to reduce the eddy currents in the iron core. Such laminations are thin magnetic material, and may be one-piece laminations where circular laminations are used in an electric motor. Where used in transformers, a popular form of laminations are the E and I laminations, which are interleaved to stagger the butt joints, and thus improve the magnetic properties of the core. In order to properly assembly these E and I laminations in staggered relationship, they were originally manually placed in the coil of wire, and more recently automatic lamination stack forming machines have been suggested, as in U.S. Pat. Nos. 4,073,373 for round laminations for a motor, or in 3,163,043; 3,280,453; and 3,423,814, for automatically stacking E and I laminations. Such automatic lamination stacking machines require considerable set-up time, and are usable primarily with only a single size of lamination for relatively long runs. Where short runs of transformer lamination stacks are to be assembled, it is often uneconomical to utilize the automatic lamination assembly machines.

If the manual assembly system is utilized for short runs, this has beenfound to be much too cumbersome today to feed one, two, or three laminations of each type into a stack of laminations and assemble them into a coil, since the limited dexterity of the workers limits the production output per hour and thus makes short runs relatively uneconomical.

SUMMARY OF THE INVENTION

The problem to be solved, therefore, is how to construct a lamination dispenser which will enable the manually inserted laminations to be done in a facile manner so that a lamination stack may be created by hand quickly and easily.

This problem is solved by a lamination dispenser for thin planar laminations comprising, in combination, a frame having guides to hold a plurality of laminations in a stack having an axis generally perpendicular to the plane of the individual laminations, abutment means movable in said frame at one end of said stack guides in the plane of the lamination at said one end, an actuator on said frame and connected to actuate said abutment means, said abutment means adapted to engage at least the end one of the laminations at said one end of the stack guides, axially adjustable means with a selected number of one or more of said laminations in said stack, said acutator adapted to transversely move said abutment means to move said selected number of laminations to a forward position relative to said frame, and sensing means connected to control said actuator to actuate said abutment means forwardly to move the selected number of laminations to the forward position upon said sensing means sensing the absence of a lamination in said forward position.

Accordingly, an object of the invention is to provide a lamination dispenser which dispenses a selected number of laminations at a position readily grasped by an operator.

Another object of the invention is to provide a lamination dispenser wherein any selected number of laminations may be dispensed to a forward position whereat a sensing device senses the presence or absence of such a lamination.

A further object of the invention is to provide a lamination dispenser wherein sensing means actuate an actuator to dispense a selected number of laminations when the sensing means senses the absence of a lamination in a dispensing position.

Other objects and a fuller understanding of the invention may be had by referring to the following description and claims, taken in conjunction with the accompanying drawing.

DESCRIPTION OF THE PREFERRED EMBODIMENTS

Figure 1:
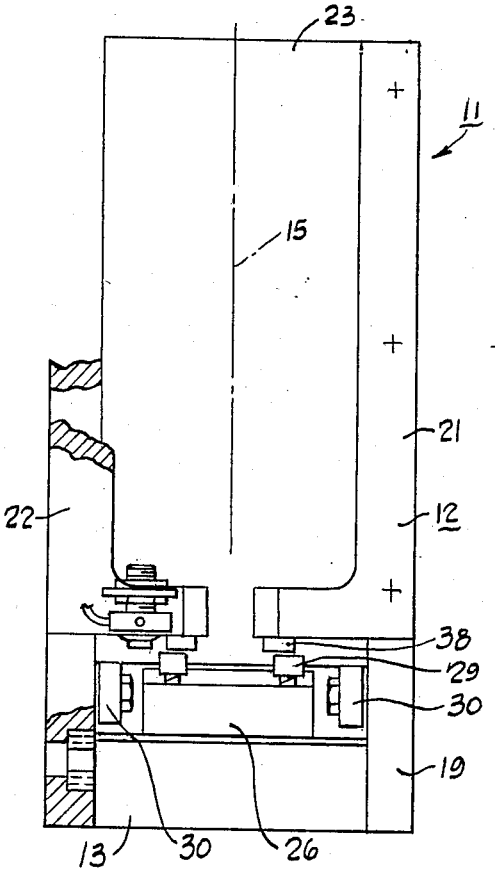
FIG. 1 is a front elevational view of a lamination dispenser incorporating the invention.
Figure 2:
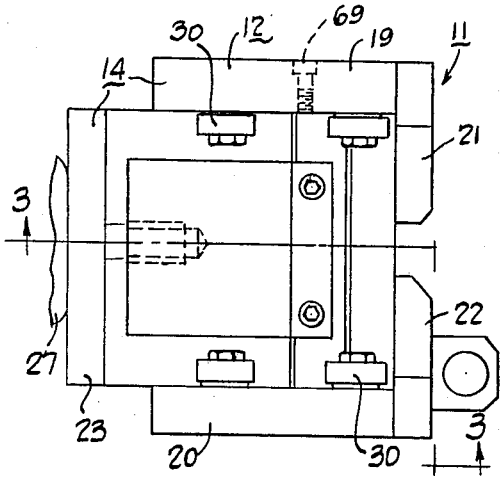
FIG. 2 is a plan view of the lamination dispenser of FIG. 1.
Figure 3:
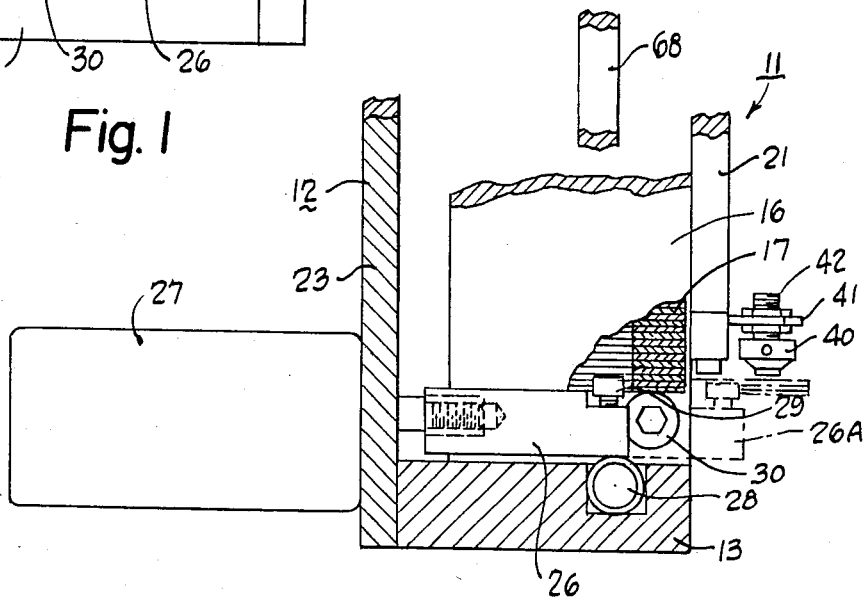
FIG. 3 is a longitudinal, sectional view on line 3—3 of FIG. 2.

FIGS. 1, 2, and 3 show generally the lamination dispenser 11 of the invention, which has a frame 12. The frame has a base 13 with guide means 14 having an axis 15. The guide means is for a stack of laminations 16, with each lamination lying in a plane normal to the axis 15. In this preferred construction, the axis 15 is vertical, and the guide means 14 is vertical. The guide means 14 is a part of the frame 12, and includes generally a right side plate 19, a left side plate 20, right and left front plates 21 and 22, respectively, and a rear plate 23, all of which are secured to the base 13. These various plates form the guide means 14 to hold the stack of laminations along the axis 15, in this case a substantially vertical axis.

Figure 4:
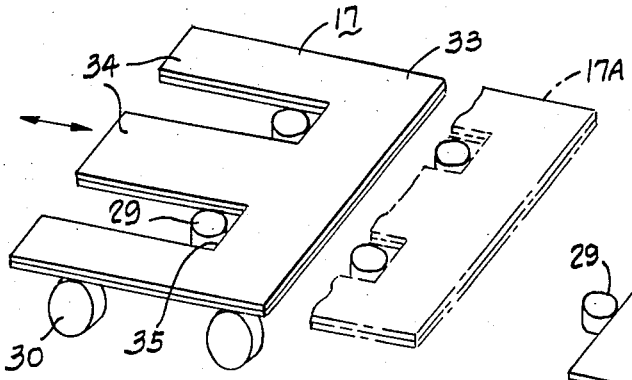
FIG. 4 is an isometric view of the lowermost laminations which are to be dispensed to a forward position and showing in phantom the forward position.
Figure 5:
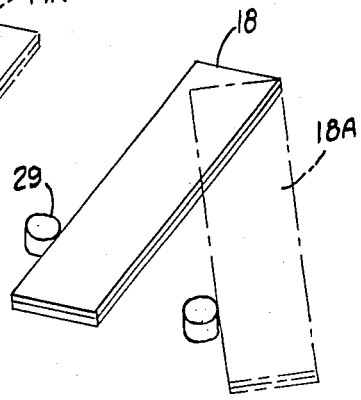
FIG. 5 is a view similar to FIG. 4, but with the dispenser set for a smaller lamination.

A slide 26 is disposed in the frame just above the base 13, and is adapted to be moved by an actuator 27 between a rearward position shown in full lines in FIG. 3, and a forward position 26A shown in phantom in FIG. 3. A roller 28 is journaled in the frame 12 to support generally the forward end of the slide 26 during its reciprocation. The slide 26 carries abutment means 29 which are adapted to abut at least the lowermost one of the laminations 17 in the stack of laminations 16. The stack of laminations is adapted to be supported on one of the slide 26 and the frame 12, and in this embodiment they are supported on the frame 12 by means of four rollers 30. The rollers support the lowermost lamination in a plane normal to the stack 15 and in this case, this is substantially a horizontal plane. The abutment means 29 in this embodiment includes first and second abutment machine screws which are threaded into the slide 26 and, by rotation, are adjustable to a height to engage a selected number of one or more of the laminations 17 at the lower end of the stack. As viewed in FIG. 4, the laminations 17 may be of E shape, or as shown in FIG. 5, the laminations 18 may be of I shape. These are examples of typical laminations used in transformers and inductance devices, and one layer in a stack will be comprised of an E and an I lamination, and then in the next layer, they will be comprised of an I and an E lamination so that the butt joints are staggered. The lamination dispenser 11 is shown in FIGS. 1–3 as being adjusted to accommodate the E laminations 17, and these E laminations have a main bar 33 with three sub-bars 34 extending from an inside edge 35. The abutment screws 29 are adapted to abut the inside edges 35 between the sub-bars 34 so that when the actuator is moved to the forward position of the slide 26A, the sub-bars 34 are stressed in tension rather than compression. This has the advantage that with extremely thin laminations such as 0.029 inch, there is no force tending to bend the laminations as there might be with a pushing force on the distal ends of the subbars 34.

Retention means 38 are provided in the frame 12 to retain within the frame guides 14 the laminations in the stack other than the selected number of laminations dispensed. This retention means is shown in this preferred embodiment as retention machine screws which are threadably adjustably mounted in an axially parallel direction in the lower end of the front frame plates 21 and 22.

Sensing means is provided to sense the presence or absence of a lamination 17A in the forward or dispensing position, as shown in phantom in FIG. 3. This sensing means 40 is shown as a proximity sensor, and is shown mounted on a bracket 41 on the front of the left front plate 22 just above the lamination 17A in the forward position. This proximity sensor 40 has a threaded mounting stud 42 to provide vertical adjustment of this proximity sensor 40 relative to the frame. Other means of vertical adjustment may readily be provided.

Figure 6:
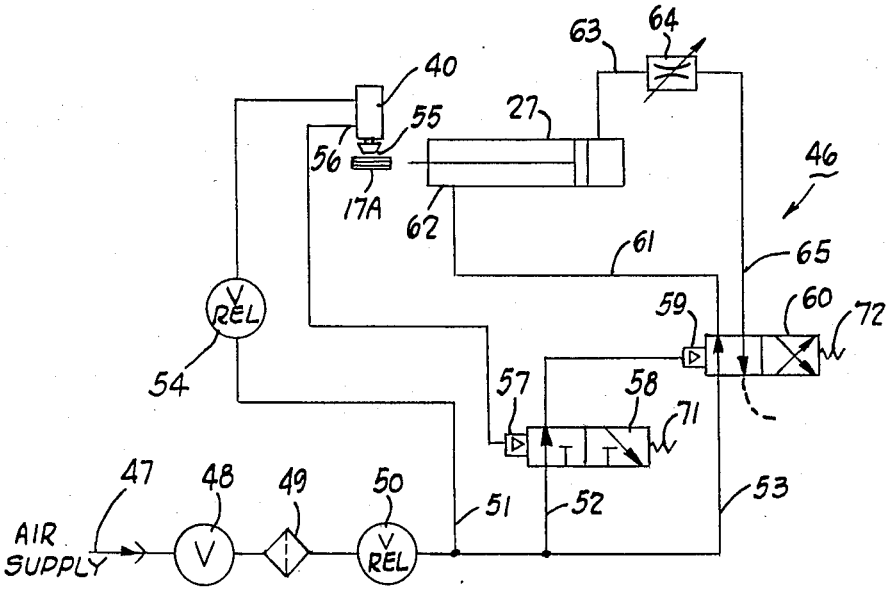
FIG. 6 is a schematic diagram of the fluid circuit of the dispenser.

FIG. 6 shows a schematic diagram of the fluid circuit 46. In this preferred embodiment, the fluid is compressed air from an air supply 47 through a main valve 48, a filter 49, and a relief valve 50, to branch lines 51, 52, and 53. The branch line 51 leads through a relief valve 54 to pneuamtic proximity sensor 40 which has a main outlet 55 just above the forward position 17A of the dispensed laminations. This proximity sensor 40 also has a secondary outlet 56 to an actuator 57 of a pilot valve 58. The branch line 52 passes through the pilot valve 58 in the actuated position shown in FIG. 6 to the actuator 59 of a four-way valve 60. The branch line 53 passes through the four-way valve 60 in the actuated position shown to a conduit 61 to the forward end 62 of the actuator 27, shown as a pneumatic cylinder and piston. A conduit 63 from the rear of the actuator 27 passes through a flow control valve 64 and a conduit 65 through the four-way valve 60 so that in the actuated position shown, it passes to atmosphere.

The lamination dispenser 11 may be adjusted to dispense various sizes of laminations 17. In FIGS. 1–3, the back plate 23 is disposed so that the vertical guide means 14 will receive the E-shaped laminations 17. To dispense smaller laminations such as the I-shaped laminations 18 shown in FIG. 5, an auxiliary back plate 68 may be mounted in the frame 12 in any suitable manner, such as by being mounted with machine screws 69 in variously placed apertures in the side plates 19 and 20. The auxiliary back plate 68 may be mounted in any suitable manner in the frame 12.

In many transformer applications, only a single lamination is dispensed at a time, so that the staggered butt joints are in but a single layer of E-I laminations. In other transformers, laminations may be stacked two at a time per layer, or three or more at a time per layer. This degrades the transformer performance somewhat but is often utilized where the specifications of the transformer will permit and a lower cost transformer is desired. The lamination dispenser 11 of the present invention provides the abutment means 29 which are adjustable in a direction parallel to the axis 15. This adjustment adjusts not only for the thickness of a single lamination, but also adjusts to select a given number of one or more laminations to be dispensed. Simply by rotating these abutment screws 29, the vertical height may be adjusted. The retention screws 38 will also preferably be adjusted in a vertical direction at the same time to retain in the stack the remainder of the laminations other than the selected number. As shown in FIG. 1, these two sets of adjustable screws are preferably positioned to have a very slight vertical clearance therebetween. Also, the pneumatic proximity sensor 40 is vertically adjusted at this time so that there is a small clearance between the main outlet 55 and the uppermost one of the selected group of laminations in the forward position 17A. This may be in the order of 0.015 inch to offer a substantial impedance to the flow of air out of this main outlet 55. The frame guides 14 may be filled with an entire stack of laminations ready to be dispensed.

With the air supply 47 operating, when the main valve 48 is opened, then this pressurizes the fluid system 46. It will be assumed that there is no lamination in the dispensing or forward position 17A, and hence there is nothing blocking escape of air through the main outlet of the pneumatic proximity sensor 40. In this condition, the proximity sensor's secondary outlet 56 is pressurized, and accordingly the spring 71 in the pilot valve moves this valve to the left from the position shown in FIG. 6, so that no air is supplied to the actuator 59 of the four-way valve 60. In this condition, the spring 72 of this valve moves this valve to the left from the position shown and air is supplied by the conduits 53 and 65 through the flow control valve 64.The variable position of this regulates the speed of actuation of the actuator 27. This actuator 27 is then moved forwardly by air pressure to dispense the selected number of laminations to the forward position 17A. As soon as there are laminations in this forward position, then the main outlet 55 of the proximity sensor 40 is effectively blocked so that air pressure is diverted to the secondary outlet 56. This actuates the pilot valve 58 and the four-way valve 60 to the position shown against the urging of the respective springs 71 and 72. Under these conditions, air pressure is supplied from conduits 53 and 61 to the forward part of the actuator 27, and the actuator 27 and slide 26 are moved to the rearward position shown in FIG. 3.

The forward position 17A of the selected number of laminations is a position at which the laminations are easily grasped by an operator. The two front plates 21 and 22 of the frame 12 are slightly separated to aid the operator in this grasping operation. The laminations may be readily withdrawn from the stack of laminations because they are supported on the rollers 30, and only the upper one of this selected group will have friction relative to the remainder of the lamination stack 16. The operator is grasping this selected group of laminations between a thumb and forefinger at the midportion of the main bar 33 of the E-shaped laminations. This means that no change of position of holding the laminations is required before the operator can insert the laminations into the coil or stacking fixture. Thus, the dispenser 11 of the present invention permits very rapid and facile stacking of the one or more laminations as desired. In a preferred embodiment, there will be several lamination dispensers so that the stacking may be readily accomplished. For example, two E lamination dispensers may be provided, one at the right and one at the left of the operator, and an I lamination dispenser at the center rear. By this means, the operator may readily grasp and place an E lamination from the right and I lamination from the left, an E lamination from the left and an I lamination from the right, to complete two separate layers with staggered butt joints in the transformer core as being stacked. This is much more rapid than the old hand assembly method of trying to take the proper number of laminations off a loose stack, tap them on a workbench to align them, and then manipulate them with both hands in order to perform the alignment and insertion into the coil or stacking fixture.

In the present invention, no misalignment need occur between the two, three or more laminations in the selected group as they are withdrawn from the dispenser and moved into the coil. Accordingly, it is not necessary to use both hands on this selected group in order to realign them, nor is it necessary to tap the group of laminations on a bench, for example, to aid this alignment. In this manner, the dispenser 11 permits very rapid assembly of the total number of laminations in the coil. It will be noted that as soon as the selected group of laminations is withdrawn from the stack, the proximity sensor 40 senses the absence of laminations so that the actuator 27 goes through its forward and reverse motions to move the next selected group of laminations to the dispensing position 17A. Thus, there is always a group of laminations ready to be grasped and withdrawn from the dispenser 11. The actuator 27 moves transversely of the axis 15 to move the selected number of laminations to a forward or dispensing position. The proximity sensor 40 senses the absence of one or more laminations in the forward position and controls the actuator 27 so that another selected group of laminations is moved to the forward position. Once these laminations are in the forward position, the proximity sensor senses this condition and the actuator is retracted. During the forward movement, the retention screws 38 retain the remainder of the lamination stack within the frame guides. During the retraction movement of the slide in abutment means 29, the selected group of laminations 17 remains in the forward position because they are supported on the rollers 30 and there is friction between the selected group of laminations and the remainder of the laminations in the stack 16. Where the I laminations are being dispensed, the stroke may be reduced so that some part of the I laminations remains under the stack when in the forward position, so that these laminations are temporarily held in this dispensing position ready to be withdrawn from the dispenser 11.

Another alternative is shown in FIG. 5, where only one abutment screw 29 is used, and the I laminations 18 have some free play between the side plates 19 and 20. In this case, the I lamination swings out at one side to be underneath the proximity sensor 40 at that side, in a position for easy grasping of the laminations. This is the position 18A shown in phantom. When the I laminations are being dispensed in a translational movement, two of the abutment screws 29 are used. However, when the E laminations 17 are being dispensed, it has been found that only one of these abutment screws 29 is needed, and also only one of the retention screws 38 is needed.

In the preferred embodiment, the axis 15 is vertical and the laminations are dispensed from the bottom of the stack. The vertical orientation means that gravity urges the stack against the rollers 30, which is a surface supporting the stack in the vertical guides 14.

The proximity sensor 40 is not an electronic sensor; instead, it is pneumatic, as is the actuator 27, and the valves 58 and 60, with their actuators 57 and 59, respectively. It will also be noted that the proximity sensor 40 is in series with the valve actuation control 57 so that when air flow out the main outlet 55 of the proximity sensor 40 is effectively blocked, the series connection of the proximity sensor 40 with the pilot valve control 47 establishes the actuation of this pilot valve, and hence actuation of the four-way valve 60.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A lamination dispenser for thin planar laminations comprising, in combination:

a frame having stack guides to hold a plurality of laminations in a stack having an axis generally perpendicular to the plane of the individual laminations;

the stack of laminations having one end along said axis;

abutment means movable in said frame in the plane of the lamination at said one end of the lamination stack;

an actuator on said frame and connected to actuate said abutment means;

said abutment means adapted to engage at least the end one of the laminations at said one end of the stack;

axially adjustable means to adjustably select engagement of said abutment means with a selected number of one or more of said laminations in said stack;

said actuator adapted for transversely moving said abutment means to move said selected number of laminations to a forward position relative to said frame yet partly in the stack; and sensing means connected to control said actuator to actuate said abutment means forwardly to move the selected number of laminations to the forward position upon said sensing means sensing the absence of a lamination in said forward position.

2. The lamination dispenser as set forth in claim 1, wherein said sensing means is connected to control said actuator to actuate said abutment means rearwardly upon said sensing means sensing the presence of a lamination in said forward position.

3. The lamination dispenser as set forth in claim 2, including means to establish said selected number of laminations stationary in the forward position relative to the frame and partly in the stack upon rearward movement of said abutment means.

4. The lamination dispenser as set forth in claim 1, including a slide movable in said frame by said actuator and carrying said abutment means.

5. The lamination dispenser as set forth in claim 4, wherein one of said slide and said frame has a surface engageable by the stack of laminations to position said one end of the stack.

6. The lamination dispenser as set forth in claim 5, including means to establish said one end of the lamination stack urged against said surface.

7. A lamination dispenser as set forth in claim 4, including a roller surface on one of said slide and said frame engageable by one end of the stack of laminations to establish the position of said one end of the stack.

8. The lamination dispenser as set forth in claim 7, wherein said roller surfce is on said frame.

9. The lamination dispenser as set forth in claim 4, including a roller bearing action between said slide and said frame.

10. The lamination dispenser as set forth in claim 1, including axially adjustable retention means on said frame to retain from transverse movement laminations in the stack other than said selected number of laminations.

11. The lamination dispenser as set forth in claim 1, wherein the laminations are E shaped having a main bar from which three sub-bars extend, the main bar having inner edges between the sub-bars, and said abutment means adapted to engage at least one of said inner edges to exert a tension force on said sub-bars.

12. The lamination dispenser as set forth in claim 1, wherein said guides and axis are substantially vertical.

13. The lamination dispenser as set forth in claim 12, wherein said one end of the stack is a lower end relative to an upper end of the stack.

14. The lamination dispenser as set forth in claim 1, wherein said sensing means is a non-contact proximity sensor.

15. The lamination dispenser as set forth in claim 14, wherein said actuator and said proxmity sensor are pneumatically operated.

16. The lamination dispenser as set forth in claim 15, including a pneumatically actuated control valve for said actuator.

17. The lamination dispenser as set forth in claim 1, including a pneumatically actuated control valve for said actuator.

18. The lamination dispenser as set forth in claim 17, wherein said sensing means is pneumatic and connected in series with said pneumatic control of said valve.

19. The lamination dispenser as set forth in claim 1, wherein said abutment means effects a swinging movement of the selected number of laminations.

20. The lamination dispenser as set forth in claim 1, wherein said abutment means effects a translational movement of the selected number of laminations.

* * * * *